US011790877B2

(12) United States Patent
Yamada et al.

(10) Patent No.: US 11,790,877 B2
(45) Date of Patent: Oct. 17, 2023

(54) SOUND SIGNAL CONVERSION DEVICE, MUSICAL INSTRUMENT, SOUND SIGNAL CONVERSION METHOD AND NON-TRANSITORY COMPUTER READABLE MEDIUM STORING SOUND SIGNAL CONVERSION PROGRAM

(71) Applicant: Yamaha Corporation, Hamamatsu (JP)

(72) Inventors: Yuji Yamada, Hamamatsu (JP); Takashi Mori, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 362 days.

(21) Appl. No.: 17/127,215

(22) Filed: Dec. 18, 2020

(65) Prior Publication Data

US 2021/0193096 A1 Jun. 24, 2021

(30) Foreign Application Priority Data

Dec. 20, 2019 (JP) ..... 2019-230723

(51) Int. Cl.
*G10H 1/053* (2006.01)
*G10H 1/00* (2006.01)
*G10H 1/047* (2006.01)

(52) U.S. Cl.
CPC ..... *G10H 1/053* (2013.01); *G10H 1/0008* (2013.01); *G10H 1/047* (2013.01)

(58) Field of Classification Search
CPC ..... G10H 1/053; G10H 1/0008; G10H 1/047
See application file for complete search history.

(56) References Cited

U.S. PATENT DOCUMENTS 3,255,297 A * 6/1966 Long ..... G10H 1/043 250/214 R
3,962,947 A * 6/1976 Michel ..... G10H 1/02 84/706
4,108,041 A * 8/1978 Moog ..... G10H 1/0091 84/706
4,308,422 A * 12/1981 Schmoll, III ..... G10H 1/043 381/62

(Continued)

FOREIGN PATENT DOCUMENTS

JP 3-125196 A 5/1991
JP 2000-214851 A 8/2000

(Continued)

OTHER PUBLICATIONS

"Introducing The Rotary Speaker Simulator Pedal 'Mini VENT' From Neo Instruments, A Lineup For Guitars And Organs", Mar. 12, 2014, Retrieved from https://www.barksip/news/?id:1000101327 with English translation, (six (6) pages).

(Continued)

*Primary Examiner* — Christina M Schreiber
(74) *Attorney, Agent, or Firm* — Crowell & Moring LLP

(57) ABSTRACT

A sound signal conversion device includes a supplier. The supplier supplies a periodic change to an input sound signal and outputs the sound signal to which the periodic change is supplied. The supplier includes a phase determiner that determines a phase at which the periodic change supplied to the sound signal starts based on initial phase information when receiving a start instruction for starting supply of the periodic change to the sound signal.

16 Claims, 7 Drawing Sheets

(56) References Cited

U.S. PATENT DOCUMENTS

| | | | | |
|---|---|---|---|---|
| 6,873,708 | B1 * | 3/2005 | Levy | H04R 3/00 84/706 |
| 2006/0195315 | A1 * | 8/2006 | Sato | G10L 13/06 704/207 |
| 2011/0291715 | A1 * | 12/2011 | Sogawa | H03L 7/23 327/156 |
| 2015/0071451 | A1 * | 3/2015 | Moon | H04S 7/305 381/62 |
| 2017/0061945 | A1 * | 3/2017 | Okazaki | G10H 1/047 |
| 2018/0090113 | A1 * | 3/2018 | Moriyama | G10H 1/42 |
| 2021/0193096 | A1 * | 6/2021 | Yamada | G10H 1/047 |

FOREIGN PATENT DOCUMENTS

| | | | |
|---|---|---|---|
| JP | 6157641 | B2 | 7/2017 |
| JP | 6547522 | B2 | 7/2019 |

OTHER PUBLICATIONS

Extended European Search Report issued in European Application No. 20214572.8 dated May 10, 2021 (12 pages).

Yamaha: "Electone "Stagea" ELS-01/01C Owner's Manual", Owner'S Manual, Jan. 1, 2007, pp. 1-240, XP040570857 (240 pages).

Music Group IP Limited: "M32 Digital Console—User Manual", MIDAS, Dec. 31, 2014, pp. 1-67 , XP055320860 , www.theaudiospecialists.eu (67 pages).

European Office Action issued in European Application No. 20 214 572.8 dated May 26, 2023 (6 pages).

Chinese-language Office Action issued in Chinese Application No. 202011477940.1 dated Apr. 26, 2023 with English translation (16 pages).

Japanese-language Office Action issued in Japanese Application No. 2019-230723 dated Aug. 8, 2023 with English translation (9 pages).

* cited by examiner

SOUND SIGNAL CONVERSION DEVICE, MUSICAL INSTRUMENT, SOUND SIGNAL CONVERSION METHOD AND NON-TRANSITORY COMPUTER READABLE MEDIUM STORING SOUND SIGNAL CONVERSION PROGRAM

BACKGROUND

Technical Field

The present disclosure relates to a sound signal conversion device, a sound signal conversion method and a non-transitory computer readable medium storing a sound signal conversion program for converting a sound signal, and a musical instrument including the sound signal conversion device.

Description of Related Art

There is a musical instrument referred to as a tonewheel organ. The tonewheel organ can create a tone color having a characteristic fluctuation and is often used for jazz or rock music. Further, a rotary speaker has been known as a speaker that is often used in combination with the tonewheel organ.

The rotary speaker includes a high-pitch speaker and a low-pitch speaker. Further, the high-pitch speaker is provided with a hone rotor, and the low-pitch speaker is provided with a drum rotor. The hone rotor and the drum rotor are rotated by a motor included in the rotary speaker, whereby a sound is output radially from the high-pitch and low-pitch speakers. Thus, effects such as a chorus, a vibrato and a tremolo are provided to the sound to be output from the high-pitch and low-pitch speakers due to the Doppler effect.

A musical sound signal generation device may generate a musical sound signal simulating a sound of an electric organ to be output from a rotary speaker.

SUMMARY

A device that generates a musical sound signal simulating a sound to be output from the rotary speaker is utilized, whereby a player can enjoy a musical performance sound similar to a sound to be output when a rotary speaker is used while using a normal speaker. Such a device does not use the rotary speaker in which a speaker rotates mechanically. Therefore, because mechanical restriction that is present in a case where the rotary speaker is actually used is not present, a musical performance sound is output without this restriction. Thus, creation of a device with a new additional value is expected.

An object of the present disclosure is to generate a musical sound signal simulating a sound to be output from a rotary speaker and output a sound signal having characteristics not provided by a mechanical rotary speaker.

An inventive sound signal conversion device includes a supplier that supplies a periodic change to an input sound signal and outputs the sound signal to which the periodic change is supplied, wherein the supplier includes a phase determiner that determines a phase at which the periodic change supplied to the sound signal starts based on initial phase information when receiving a start instruction for starting supply of the periodic change to the sound signal.

Other objects, advantages and novel features of the embodiments of the present disclosure will become apparent from the following detailed description of one or more preferred embodiments when considered in conjunction with the accompanying drawings, in which:

DETAILED DESCRIPTION

A sound signal conversion device, a sound signal conversion method, a sound signal conversion program and a musical instrument according to embodiments of the present disclosure will be described below in detail with reference to the drawings.

(1) Periodic Change of Sound Signal

Prior to the description of the sound signal conversion device, the sound signal conversion method, the sound signal conversion program and the musical instrument of the present embodiment, definition of the terms used in the present embodiment will be described. The sound signal conversion device of the present embodiment supplies a periodic change to a sound signal. The periodic change refers to a periodic change of the pitch, the volume or the sound quality of a sound signal. The periodic change is supplied to a sound signal in this manner, so that the sound signal simulating a sound to be output from a rotary speaker can be output.

(2) Configuration of Musical Instrument

Figure 1:
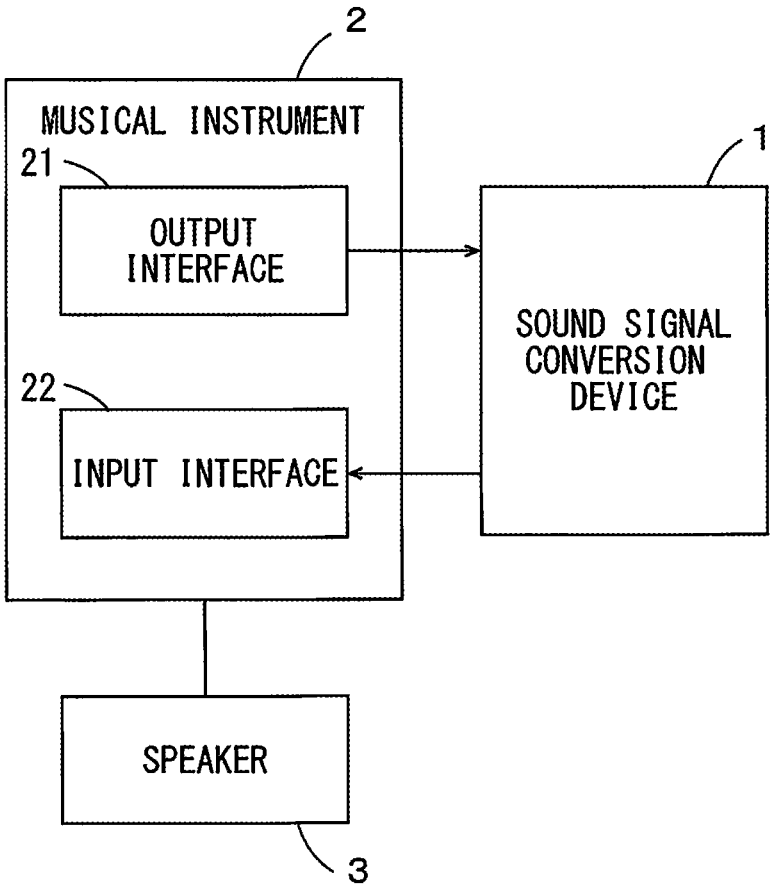
FIG. 1 is a block diagram showing a sound signal conversion device and a musical instrument to which the sound signal conversion device is connected.

FIG. 1 is a block diagram showing the sound signal conversion device 1 according to the embodiment of the present disclosure and the musical instrument 2 according to the present embodiment of the present disclosure to which the sound signal conversion device 1 is connected. The musical instrument 2 of FIG. 1 is an electronic keyboard musical instrument, for example. The musical instrument 2 includes an output interface 21 and an input interface 22. When a player performs a performance operation, the musical instrument 2 outputs a sound signal via the output interface 21. The sound signal conversion device 1 receives the sound signal that is output from the output interface 21.

The sound signal conversion device 1 converts the sound signal that is received from the musical instrument 2. Specifically, the sound signal conversion device 1 converts the sound signal by supplying a periodic change to the sound signal. That is, the sound signal converted by the sound signal conversion device 1 is a signal simulating a sound that is obtained when the sound signal output from the musical instrument 2 is output via the rotary speaker.

The sound signal conversion device 1 outputs the converted sound signal. The musical instrument 2 receives the converted sound signal that is output from the sound signal conversion device 1 via the input interface 22. The musical instrument 2 outputs the sound signal that is converted in the sound signal conversion device 1 from a speaker 3. Thus, when the player performs a performance operation on the musical instrument 2, a musical performance sound having a fluctuation such as a sound to be output from the rotary speaker is output from the speaker 3.

(3) Configuration of Sound Signal Conversion Device

Figure 2:
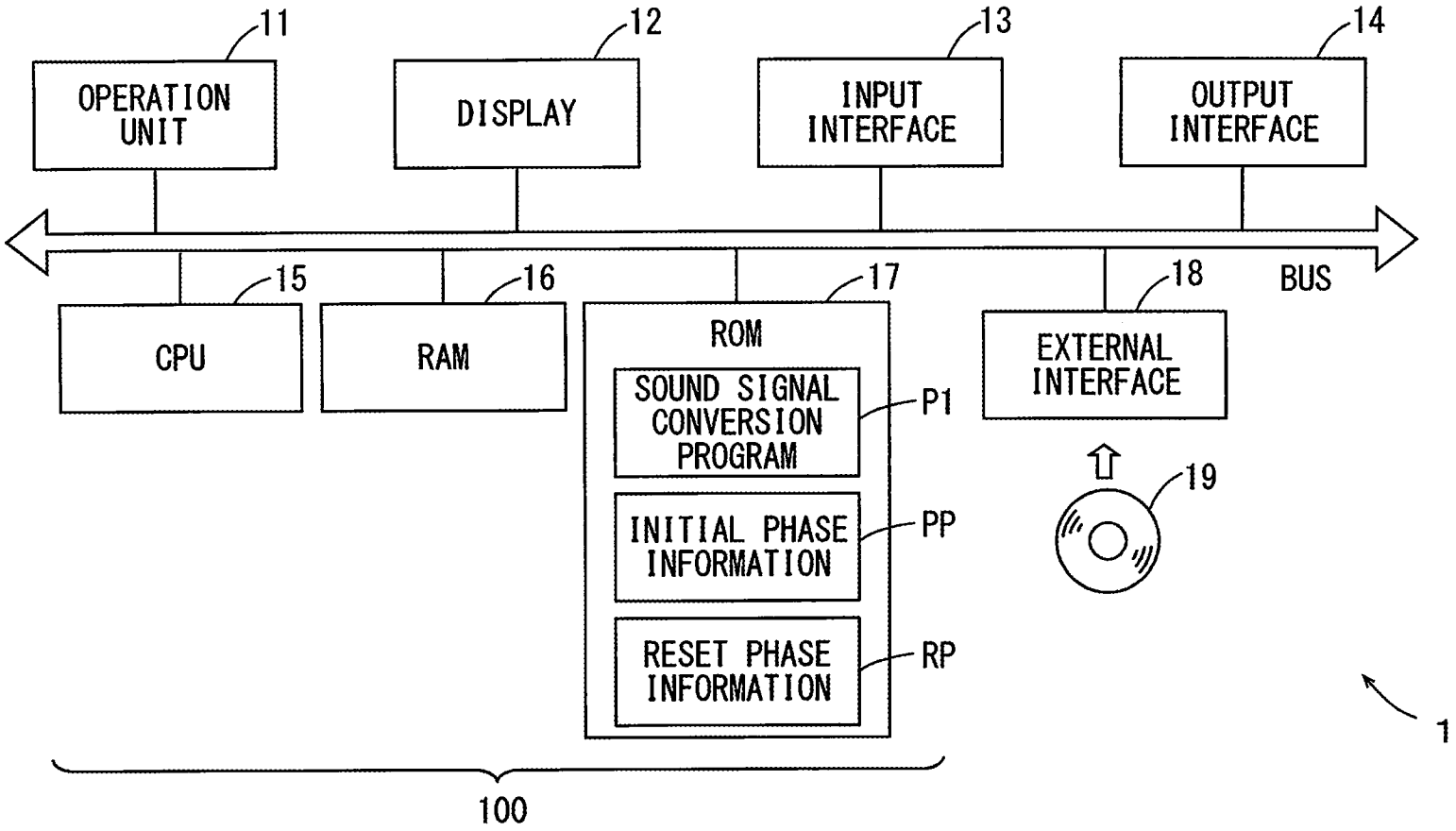
FIG. 2 is a block diagram showing the configuration of the sound signal conversion device.

FIG. 2 is a block diagram of the functions of the sound signal conversion device 1 according to the embodiment of the present disclosure. The sound signal conversion device 1 includes an operation unit 11, a display 12, an input interface 13, an output interface 14 and an external interface 18. The operation unit 11, the display 12, the input interface 13, the output interface 14 and the external interface 18 are connected to a bus.

The operation unit 11 is an operator that accepts an operation that is performed on the sound signal conversion device 1. The player operates the operation unit 11, thereby providing an instruction for starting or stopping conversion of a sound signal to the sound signal conversion device 1. The display 12 is a device that displays a state of the sound signal conversion device 1. For example, an LED is used in the display 12.

The input interface 13 receives a sound signal. In a case where the sound signal conversion device 1 is connected to the musical instrument 2 shown in FIG. 1, the input interface 13 receives a sound signal that is output by the musical instrument 2 via the output interface 21. The output interface 14 outputs a sound signal. In a case where the sound signal conversion device 1 is connected to the musical instrument 2 shown in FIG. 1, the musical instrument 2 receives a sound signal that is output from the output interface 14 via the input interface 22.

The sound signal conversion device 1 further includes a CPU (Central Processing Unit) 15, a RAM (Random Access Memory) 16 and a ROM (Read Only Memory) 17. The CPU 15, the RAM 16 and the ROM 17 are connected to the bus.

The ROM 17 is made of a non-volatile memory, for example, and stores various data including a program. In the present embodiment, EEPROM such as a flash memory is used as the ROM 17, and various data can be rewritten. A sound signal conversion program P1, initial phase information PP and reset phase information RP are stored in the ROM 17. The RAM 16 is made of a volatile memory, for example, is used as a work area for the CPU 15 and temporarily stores various data.

The CPU 15 performs the below-mentioned sound signal conversion method by executing the sound signal conversion program P1 stored in the ROM 17. The CPU 15, the RAM 16 and the ROM 17 constitute a controller 100 of the sound signal conversion device 1.

While the sound signal conversion program P1, the initial phase information PP and the reset phase information RP are stored in the ROM 17 in the present embodiment, these data may be stored in an external storage device such as a hard disc. Further, the sound signal conversion program P1 may be supplied in the form of being stored in a recording medium 19 which is readable by a computer such as a CD-ROM, a DVD-ROM or a flash memory and installed in the ROM 17 or the external storage device. Further, the CPU 15 may execute the sound signal conversion program P1 stored in the recording medium 19 via the external interface 18. Further, in a case where the sound signal conversion device 1 is connected to a communication network, the sound signal conversion program P1 distributed from a server connected to the communication network may be installed in the ROM 17.

(4) Configuration of Controller of Sound Signal Conversion Device 1

Figure 3:
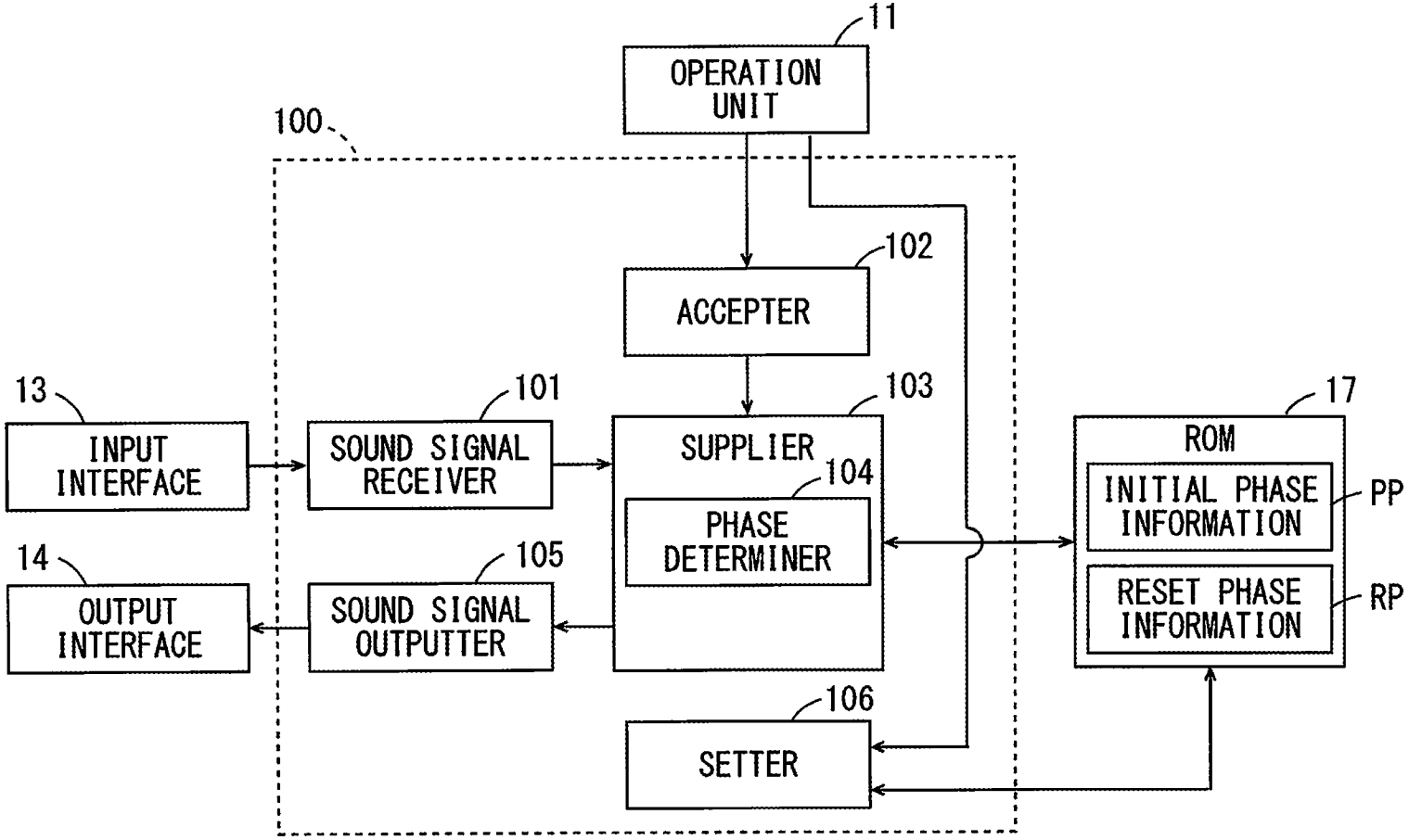
FIG. 3 is a block diagram showing the functions of the sound signal conversion device.

FIG. 3 is a block diagram showing the functional configuration of the controller 100 included in the sound signal conversion device 1. As shown in FIG. 3, the controller 100 includes a sound signal receiver 101, an accepter 102, a supplier 103, a sound signal outputter 105 and a setter 106. The supplier 103 has a phase determiner 104. The function of each constituent element (101 to 106) of the controller 100 is implemented when the CPU 15 of FIG. 1 executes the sound signal conversion program P1 stored in the ROM 17 while using the RAM 16 as a work area.

The sound signal receiver 101 receives a sound signal via the input interface 13. In a case where the sound signal conversion device 1 is connected to the musical instrument 2, the sound signal receiver 101 receives a sound signal from the musical instrument 2. The sound signal that is received from the musical instrument 2 is a signal of a musical performance sound generated by the player of the musical instrument 2.

Figure 4:
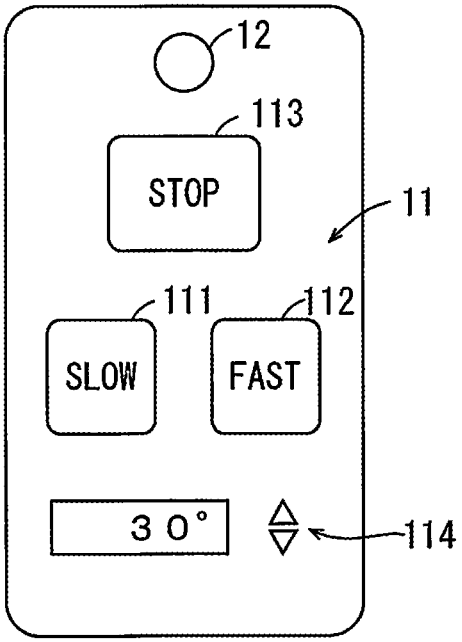
FIG. 4 is a diagram showing one example of an operation unit of the sound signal conversion device.

The accepter 102 accepts an operation performed using the operation unit 11. FIG. 4 is a diagram showing one example of the operation unit 11 and the display 12. The operation unit 11 includes a SLOW button 111, a FAST button 112, a STOP button 113 and a reset phase setting button 114.

The SLOW button 111 is a button for setting the periodic velocity of a periodic change supplied to a sound signal lower. The FAST button 112 is a button for setting the periodic velocity of a periodic change supplied to a sound signal higher. As described above, the sound signal conversion device 1 simulates a sound to be output from the rotary speaker and converts a sound signal. Decreasing or increasing the periodic velocity of a periodic change corresponds to the simulation of a sound to be output in a case where the rotational velocity of the rotary speaker is decreased or increased.

The STOP button 113 is a button for providing an instruction for stopping the supply of a periodic change to a sound signal. When the STOP button 113 is depressed one time, the supply of the periodic change to the sound signal is stopped, and the current phase of the periodic change is held as an initial phase. Holding of the current phase of the periodic change as the initial phase corresponds to the stop of supply of a periodic change to the sound signal and simulatively corresponds to the stop of rotation of the rotary speaker at a current position. When the STOP button is held down, the supply of the periodic change to the sound signal stops, and a reset phase is set as the initial phase. Setting of the reset phase as the initial phase corresponds to the stop of supply of the periodic change to the sound signal and simulatively corresponds to the movement of rotation of the rotary speaker to a reset rotation position. An initial phase is a phase at which the supply of a periodic change to a sound signal starts. A reset phase is a phase that is set as an initial phase in accordance with preference of the player. Details of the initial phase and the reset phase will be described below.

The reset phase setting button 114 is a button that is operated by the player and for setting a reset phase. When the STOP button 113 is held down, an initial phase is set based on a reset phase. The player can freely set the reset phase in the range of 0° to 360° (alternatively, the range may be from −180° to 180°.) The display 12 displays a current operating state of the sound signal conversion device 1. For example, when a conversion process of a sound signal is in execution because the SLOW button 111 is depressed, the display 12 may be lit up in red. When the conversion process of a sound signal is in execution because the FAST button 112 is depressed, the display 12 may be lit up in green. The operation unit 11 and the display 12 are arranged on the surface or the like of the sound signal conversion device 1.

Reference is made to FIG. 3 again. The supplier 103 supplies a periodic change to a sound signal that is received from the sound signal receiver 101. The supplier 103 supplies the periodic change to the pitch, the volume, the sound quality or the like of the sound signal. For example, in a case where the periodic change is supplied to the pitch of the sound signal, the supplier 103 multiplies the pitch (frequency) of the sound signal by a coefficient that changes periodically. While the method of determining a multiplication coefficient is not limited in particular, a multiplication coefficient may be determined such that a sound to be output from the rotary speaker is simulated, for example. The period of the periodic change is determined based on which button between the SLOW button 111 and the FAST button 112 the player depressed.

The phase determiner 104 determines an initial phase of a periodic change supplied to a sound signal. The phase determiner 104 determines the initial phase based on the initial phase information PP stored in the ROM 17.

Further, the phase determiner 104 executes an update process of the initial phase information PP. When the player depresses the STOP button 113 one time, the phase determiner 104 acquires a current phase of the periodic change supplied to the sound signal and updates the initial phase information PP based on the acquired current phase. When the player holds down the STOP button 113, the phase determiner 104 updates the initial phase information PP based on the reset phase information RP.

The reset phase information RP is set by the player. When the player operates the above-mentioned reset phase setting button 114 and inputs the value of a reset phase, the setter 106 updates the reset phase information stored in the ROM 17.

The sound signal outputter 105 outputs a sound signal to which a periodic change is supplied by the supplier 103. The converted sound signal that is output from the sound signal outputter 105 is output to the musical instrument 2 via the output interface 14.

(5) One Example of Sound Signal Conversion Method

Figure 5:
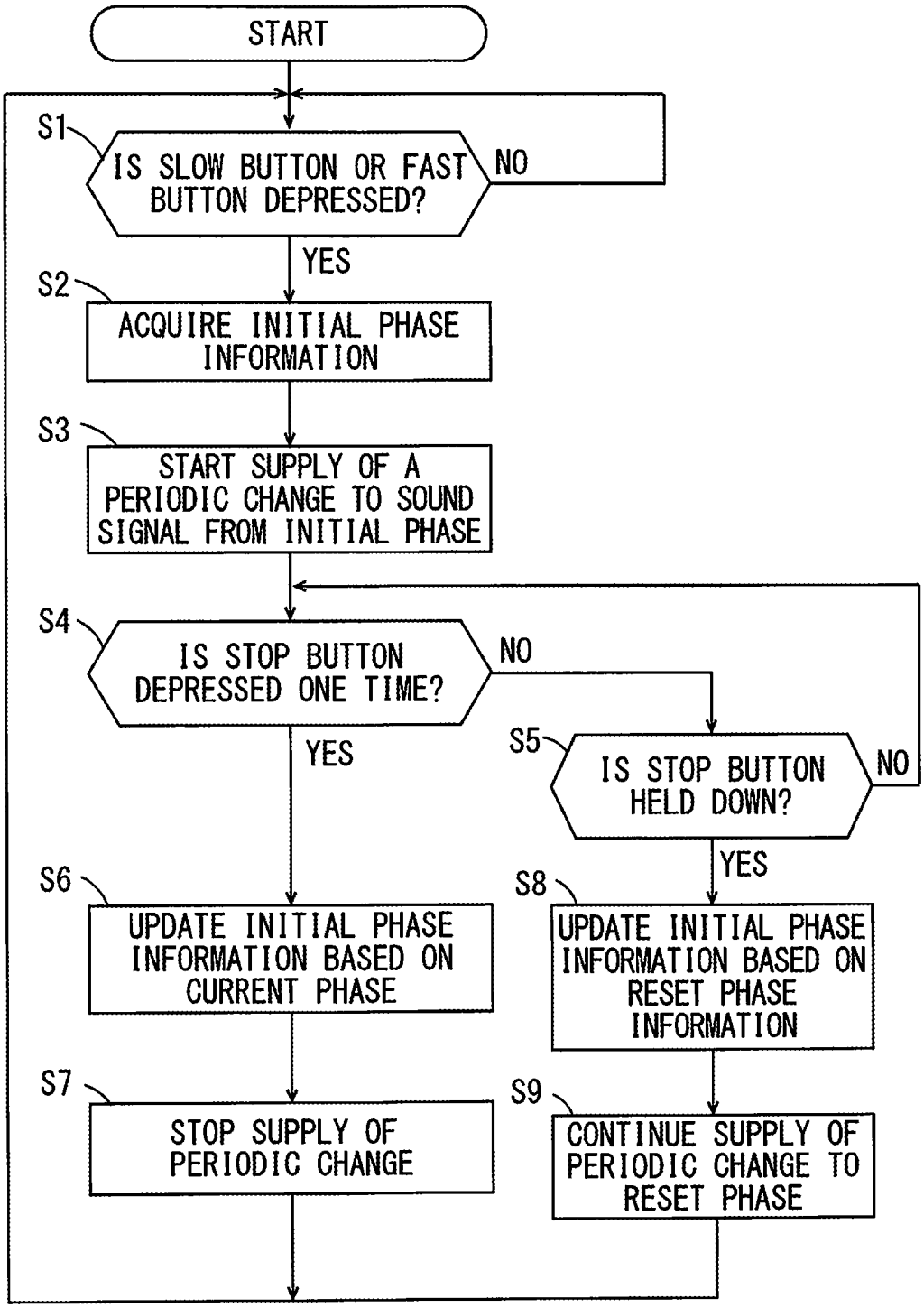
FIG. 5 is a flowchart showing a sound signal conversion method.
Figure 6:
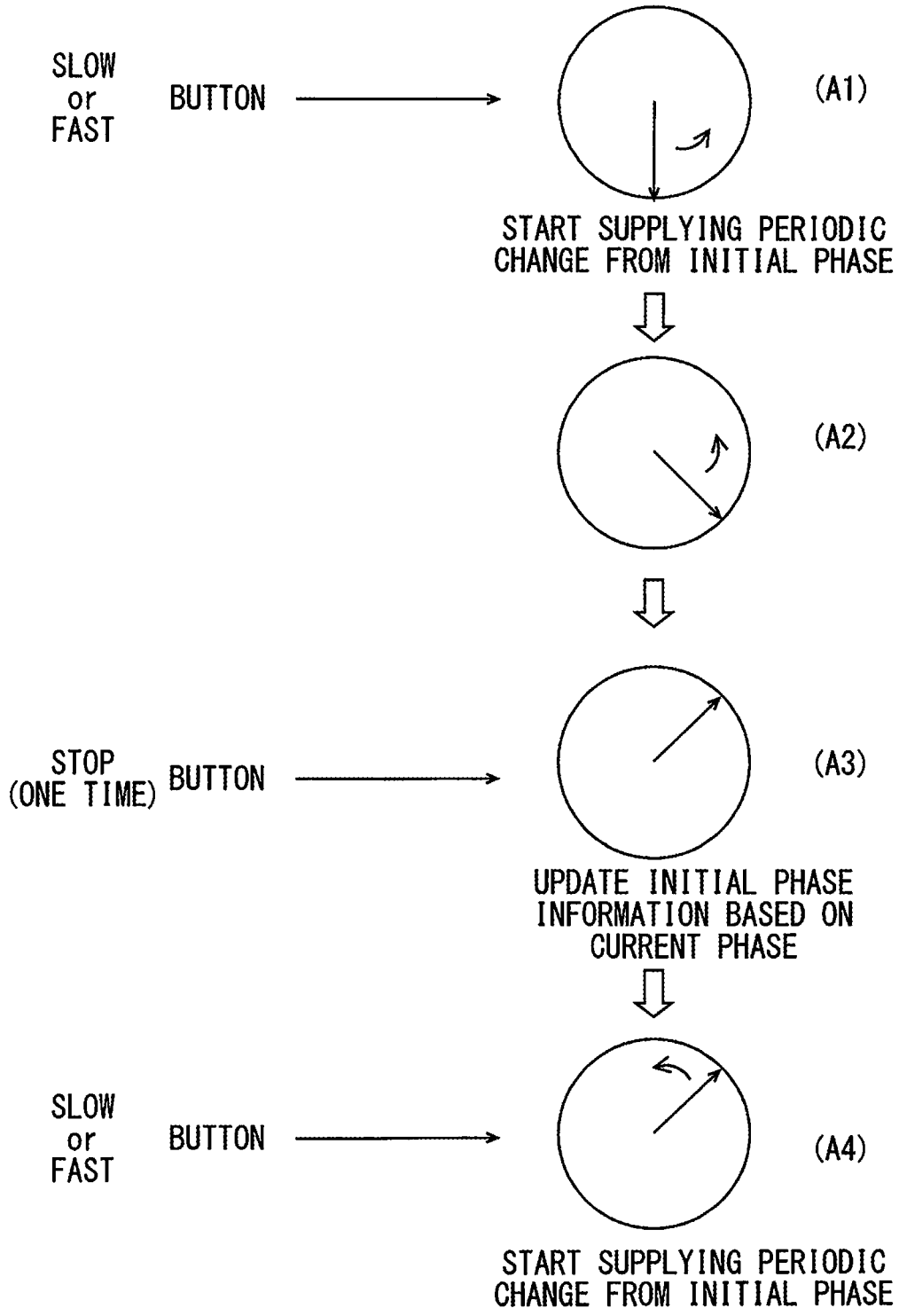
FIG. 6 is a diagram in which a phase of a periodic change supplied to a sound signal corresponds to a rotation position of a rotary speaker.
Figure 7:
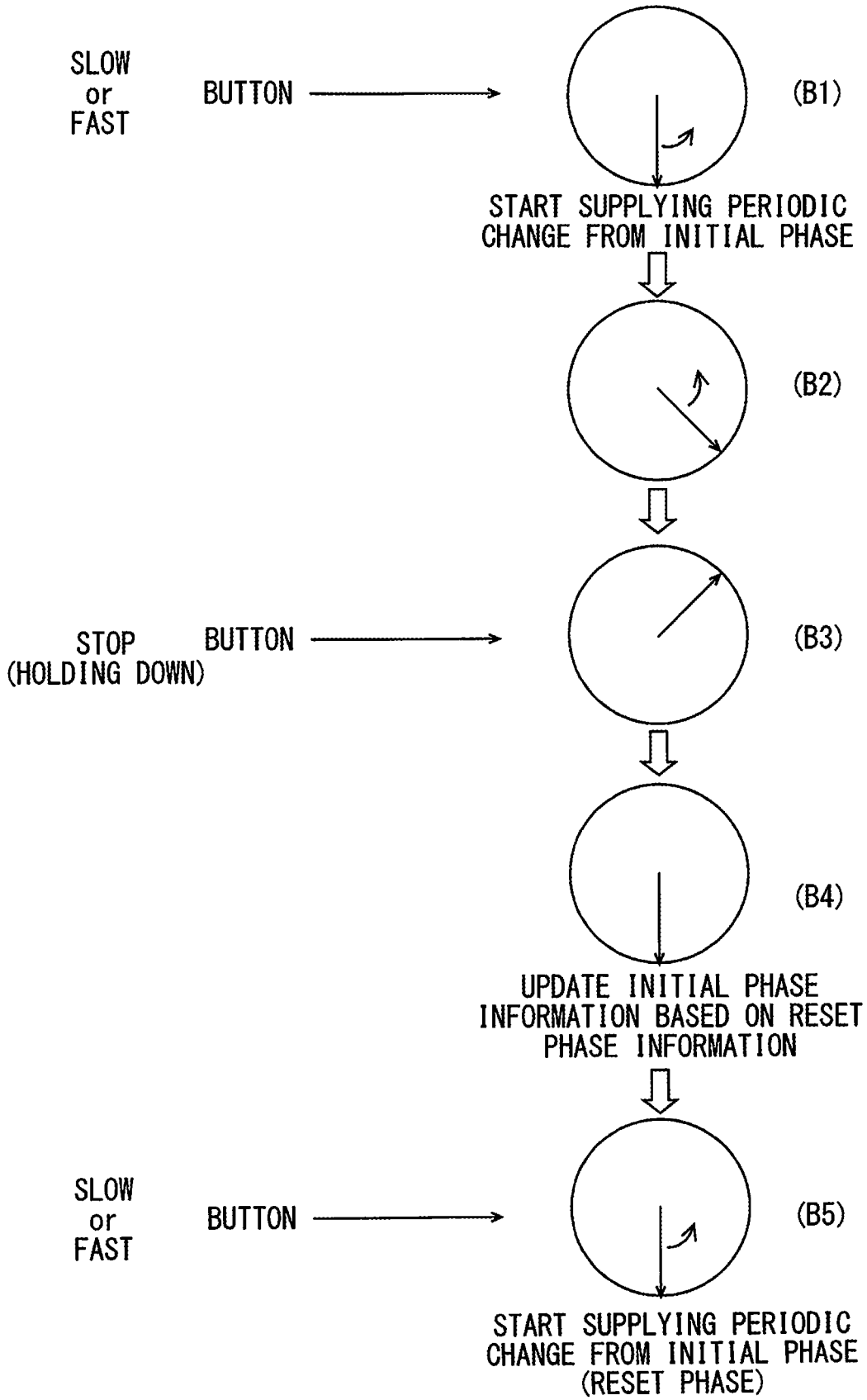
FIG. 7 is a diagram in which the phase of the periodical phase supplied to the sound signal corresponds to the rotation position of the rotary speaker.

FIG. 5 is a flowchart showing the sound signal conversion method performed in the sound signal conversion device 1 of FIG. 3. The sound signal conversion method of FIG. 5 is performed when the CPU 15 of FIG. 2 executes the sound signal conversion program P1 stored in the ROM 17. FIGS. 6 and 7 are diagrams in which the phases of a sound signal simulatively correspond to the rotation positions of the rotary speaker.

Reference is made to FIG. 5. First, the accepter 102 determines whether the SLOW button 111 or the FAST button 112 is depressed (step S1). In a case where neither the SLOW button 111 nor the FAST button 112 is depressed, the determination process of the step S1 is repeated. In a case where the SLOW button 111 or the FAST button 112 is depressed, the phase determiner 104 acquires the initial phase information PP stored in the ROM 17 (step S2). The phase determiner 104 determines an initial phase based on the initial phase information PP.

Next, the supplier 103 supplies a periodic change to a sound signal that is received from the sound signal receiver 101. Specifically, the supplier 103 supplies a periodic change that starts from the initial phase determined by the phase determiner 104 to the sound signal (step S3). For example, in a case where the initial phase is at 30°, the supplier 103 supplies a periodic change that starts from the phase of 30° to the sound signal. This means that the sound to be output when the rotary speaker starts rotating from the position where the rotary speaker is rotated by 30° from an forwardly oriented position is simulated. In a case where the initial phase is at 0°, the sound to be output when the rotary speaker starts rotating from the forwardly oriented position is simulated. The periodic velocity of a periodic change is determined based on which one of the SLOW button 111 and the FAST button 112 is depressed.

Next, the accepter 102 determines whether the STOP button 113 is depressed one time (step S4). One-time depression of the STOP button 113 refers to a case where the STOP button 113 is depressed for a short period of time and not held down. The accepter 102 compares the period of time during which the STOP button 113 is depressed with a predetermined threshold value. In a case where the period of time during which the STOP button 113 is depressed is smaller than the predetermined threshold value, it is determined that the STOP button 113 is depressed one time.

In a case where the STOP button 113 is depressed one time, the phase determiner 104 acquires a current phase of a periodic change at a point in time at which the STOP button 113 is depressed one time. The phase determiner 104 updates the initial phase information PP based on the acquired current phase (step S6), and then the supplier 103 stops the supply of a periodic change to the sound signal (step S7). One-time depression of the STOP button corresponds to "a case where the reset phase information is not supplied" in the present disclosure. After the step S7, the process returns to the step S1 again, and the accepter 102 determines whether the SLOW button 111 or the FAST button 112 is depressed.

In the step S4, in a case where it is not determined that the STOP button is depressed one time, the accepter 102 determines whether the STOP button 113 is held down (step S5). In a case where the period of time during which the STOP button 113 is depressed is equal to or larger than the above-mentioned predetermined threshold value, the accepter 102 determines that the STOP button 113 is held down.

In a case where the STOP button 113 is held down, the phase determiner 104 acquires the reset phase information RP from the ROM 17. The phase determiner 104 updates the initial phase information PP based on the reset phase information RP (step S8). Subsequently, the supplier 103 continues supplying a periodic change to the sound signal until the sound signal is at a reset phase (step S9). At a point in time at which a periodic change supplied to the sound signal coincides with the reset phase, the supplier 103 stops supplying a periodic change to the sound signal. Holding down of the STOP button 113 corresponds to "a case where the reset phase information is supplied" in the present disclosure. After the step S9, the process returns to the step S1 again, and the accepter 102 determines whether the SLOW button 111 or the FAST button 112 is depressed.

As described above, the phase at which the player desires a periodic change to start is stored as the reset phase information RP. The player sets the reset phase information RP in advance by operating the reset phase setting button 114. The player can set the reset phase as the start phase of a periodic change supplied to the sound signal by holding down the STOP button 113.

In the step S9, continuation of the supply of a periodic change to the sound signal by the supplier 103 until the sound signal is at the reset phase corresponds to continuation of rotation of the rotary speaker until the rotary speaker is at a reset position. For example, the reset phase being at 0° corresponds to the rotary speaker rotating to a forwardly oriented position (reset position) and stopping rotating. As a matter of course, when the STOP button 113 is held down, the supplier 103 may immediately stop supplying a periodic change to the sound signal. Because a rotary speaker that rotates mechanically is not used, even in a case where the supply of a periodic change to the sound signal is immediately stopped, the initial phase information PP can be updated based on the reset phase information RP.

The example in which the phase of a periodic change supplied to the sound signal simulatively corresponds to the rotation position of the rotary speaker will be described next. FIGS. 6 and 7 are diagrams in which the phase of a periodic change supplied to the sound signal corresponds to the rotation position of the rotary speaker.

First, the example in which the STOP button 113 is depressed one time will be described with reference to FIG. 6. As shown in FIG. 6 (A1), when the player depresses the SLOW button 111 or the FAST button 112, the supply of a periodic change to a sound signal starts from an initial phase. Here, 0° is stored as the initial phase information PP, by way of example. Therefore, the periodic change supplied to the sound signal corresponds to the operation of starting rotation performed by the rotary speaker that outputs a sound from a forwardly oriented position.

Thereafter, as shown in FIG. 6 (A2), the phase of the periodic change supplied to the sound signal changes. This corresponds to the rotary speaker's operation of outputting a sound while rotating from the forwardly oriented position. The velocity of the periodic change determined by the SLOW button 111 or the FAST button 112 corresponds to the rotation speed of the rotary speaker.

Next, as shown in FIG. 6 (A3), when the player depresses the STOP button 113 one time, the phase determiner 104 updates the initial phase information PP based on a current phase. This corresponds to the rotary speaker's operation of stopping rotating at a point in time at which the STOP button is depressed.

As shown in FIG. 6 (A4), when the player depresses the SLOW button 111 or the FAST button 112 again, the supply of the periodic change to the sound signal starts from an initial phase. Because the current phase is stored as the initial phase information PP in FIG. 6 (A3), the periodic change starts at the phase at which the rotation is stopped in FIG. 6 (A3). This corresponds to the rotary speaker's operation of starting rotating again from a position at which the rotation is stopped in FIG. 6 (A3).

Next, the example in which the STOP button 113 is held down will be described with reference to FIG. 7. FIGS. 7 (B1) and 7 (B2) are similar to FIGS. 6 (A1) and 6 (A2). Next, as shown in FIG. 7 (B3), when the player holds down the STOP button 113, the phase determiner 104 updates the initial phase information PP based on the reset phase information RP as shown in FIG. 7 (B4). This corresponds to the rotation of the rotary speaker to a preset reset position and stopping rotation of the rotary speaker after the STOP button 113 is held down. In a case where 0° is set as the reset phase information RP, updating of the initial phase information PP based on the reset phase information RP corresponds to the rotary speaker's operation of rotating to a forwardly oriented position and stopping rotating.

Next, as shown in FIG. 7 (B5), when the player depresses the SLOW button 111 or the FAST button 112, the periodic change supplied to the sound signal starts from the initial phase (reset phase). In FIG. 7 (B4), the reset phase is stored as the initial phase information PP, the periodic change does not start from the phase of a point in time at which the STOP button 113 is depressed in FIG. 7 (B3) but starts from the reset phase.

(6) Effects of Embodiments

With the present embodiment, the phase at which a periodic change supplied to a sound signal starts is determined based on the initial phase information PP. While outputting a sound simulating a sound to be output from a rotary speaker, the sound signal conversion device 1 does not include the rotary speaker that actually rotates. As such, the sound signal conversion device 1 takes advantage of not having the restriction of the rotary speaker that rotates mechanically and makes determination about the periodic change based on the initial phase information, thereby being able to output a sound signal having unconventional characteristics. The musical instrument 2 to which the sound signal conversion device 1 is connected can produce a musical performance sound in which the periodic change starts based on the initial phase information PP.

Further, with the present embodiment, when a stop instruction for stopping the supply of the periodic change is accepted by the accepter 102, in a case where the reset phase information RP is provided, the initial phase information PP is updated based on the reset phase information RP. The player can start the periodic change from a predetermined phase by utilizing the reset phase information RP. For example, at the start of a musical performance, because the periodic change can start from the same phase, a musical performance sound that is not obtained using the rotary speaker that rotates mechanically can be output.

Further, with the present embodiment, when a stop instruction for stopping the supply of the periodic change is accepted by the accepter 102, in a case where the reset phase information RP is not provided, the initial phase information PP is updated based on a current phase of the periodic change with respect to a sound signal. When starting the supply of the periodic change the following time, the sound signal conversion device 1 can start the supply of the periodic change from the phase at which the stop instruction is accepted. The player can obtain a performance feeling similarly to the time when the rotary speaker is actually used.

Further, with the present embodiment, because the setter 106 for setting the reset phase information RP is included, the player can set a desirable phase at which the periodic change starts. The setter 106 can set a phase different from the phase corresponding to the sound to be output when the rotary speaker is oriented forwardly as the reset phase information RP. For example, the initial phase can be determined in accordance with the preference of the player such that the periodic change starts from the phase corresponding to the position at which the rotary speaker is rotated by 30°, for example. The volume is relatively the largest during the periodic change when the rotary speaker is oriented forwardly. Thus, some players may feel that the phase is unsuitable as the initial phase at the start of a musical performance. With the present embodiment, the initial phase can be set freely in accordance with such preference of the player.

In the above-mentioned embodiment, the supplier 103 supplies a periodic change to a sound signal. In another embodiment, the supplier 103 may supply a periodic change based on a plurality of phases to a sound signal. At this time, the supplier 103 may start the periodic change based on a plurality of initial phase information pieces. Further, in regard to the periodic change based on the plurality of phases, the rotation directions of phases may be the same or opposite to one another. In a case where the rotation directions of phases are opposite to one another, a sound to be output from a rotary speaker including a horn rotor and a drum rotor can be simulated, for example.

In the above-mentioned embodiment, when the STOP button 113 was held down, the initial phase information PP was updated based on the reset phase information RP stored in the ROM 17. In another embodiment, when the STOP button 113 is held down, a reset phase may be determined randomly. At this time, the phases may be determined randomly except for the phase corresponding to a case where the rotary speaker is oriented forwardly.

In the above-mentioned embodiment, when the STOP button 113 was depressed one time, the initial phase information PP was updated based on a current phase in the step S6 of FIG. 5. In another embodiment, after the STOP button 113 is depressed one time, the initial phase information PP may be updated with the phase at which a sound signal is positioned after a predetermined period of time elapses as a current phase. The predetermined period of time can be changed in accordance with which one of the SLOW button 111 and the FAST button 112 is depressed for the supply of a periodic change. At this time, after the STOP button 113 is depressed one time, the change in phase of the periodic change may gradually slow down. This enables simulation of the rotary speaker's operation of gradually slowing down the rotation and stopping rotating.

In the above-mentioned embodiment, the STOP button 113 was held down, and then the supply of a periodic change continued until the sound signal was at the reset phase. In another embodiment, when the STOP button is held down, the output from the sound signal conversion device 1 may be muted. In that case, the output may be unmuted after a predetermined period of time elapses, or may be automatically unmuted in association with a musical performance operation of the player.

In the above-mentioned embodiment, when the STOP button 113 was held down, the initial phase information PP was updated based on the reset phase information RP. In a separate embodiment, when the STOP button 113 is double-clicked, similar effects may be provided. Alternatively, another button for resetting may be provided.

In the embodiment described with reference to FIGS. 6 and 7, the rotation direction of the periodic change is counter-clockwise, by way of example. In the sound signal conversion device 1, the rotation direction of the periodic change may be set to clockwise or counter clockwise.

In the above-mentioned embodiment, the sound signal conversion device 1 is connected to the musical instrument 2, by way of example. In another embodiment, the sound signal conversion device 1 may be incorporated in the musical instrument 2. In a case where the sound signal conversion device 1 is incorporated in the musical instrument 2, the operation unit 11 and the display 12 may be provided at the body of the musical instrument 2. In a case where the musical instrument 2 is an electronic keyboard instrument, for example, the operation unit 11 and the display 12 may be provided in the back or side of a keyboard. The sound signal conversion device 1 can be connected to various musical instruments such as an electric guitar or an electric acoustic guitar in addition to an electronic keyboard instrument.

In the above-mentioned embodiment, the sound signal conversion device 1 is connected to the musical instrument 2, by way of example. In another embodiment, the functions of the sound signal conversion device 1 can be provided in a cloud server. For example, the sound data that is output from a musical instrument may be divided based on a predetermined frame size to be transmitted to a cloud server as files or packets, and a sound signal may be converted in the cloud server. The musical instrument can output a converted sound signal that is received from the cloud server. Alternatively, sound data may be transmitted to the cloud server from a smartphone or a tablet terminal instead of a musical instrument.

(7) Characteristics of Embodiments

The sound signal conversion device, the musical instrument, the sound signal conversion method and the sound signal conversion program of the above-mentioned embodiments of the present disclosure include the following characteristics.

A sound signal conversion device according to one aspect of the present disclosure includes a supplier that supplies a periodic change to an input sound signal and outputs the sound signal to which the periodic change is supplied, wherein the supplier includes a phase determiner that determines a phase at which the periodic change supplied to the sound signal starts based on initial phase information when receiving a start instruction for starting supply of the periodic change to the sound signal.

The supplier may stop supplying the periodic change to the sound signal and updates the initial phase information based on reset phase information, when accepting a stop instruction for stopping the supply of the periodic change to the sound signal, in a case where being provided with the reset phase information.

The supplier may stop supplying the periodic change to the sound signal and update the initial phase information based on a current phase of the periodic change with respect to the sound signal, when accepting the stop instruction, in a case where not being provided with the reset phase information.

The supplier may update the initial phase information based on the reset phase information that is set by a setter.

A phase different from a phase corresponding to a sound to be output when a rotary speaker is oriented forwardly may be set as the reset phase information by the setter in a case where the periodic change of the sound signal corresponds to a sound to be output from the rotary speaker.

The phase determiner may determine a plurality of phases at which the periodic change supplied to the sound signal starts based on a plurality of initial phase information pieces, and the supplier may supply a periodic change to the sound signal based on the plurality of phases.

A musical instrument according to another aspect of the present disclosure includes the above-mentioned sound signal conversion device.

A sound signal conversion method according to yet another aspect of the present disclosure of receiving a sound signal, accepting a start instruction for starting supply of a periodic change to the sound signal, determining a phase at which the periodic change supplied to the sound signal starts based on initial phase information when the start instruction is accepted, and supplying the periodic change to the sound signal, and outputting the sound signal to which the periodic change is supplied.

The supplying may include stopping supplying the periodic change to the sound signal and updating the initial phase information based on reset phase information, when a stop instruction for stopping the supply of the periodic change to the sound signal is accepted, in a case where the reset phase information is provided.

The supplying may include stopping supplying the periodic change to the sound signal and updating the initial phase information based on a current phase of the periodic change with respect to the sound signal, when the stop instruction is accepted, in a case where the reset phase information is not provided.

The supplying may include updating the initial phase information based on the reset phase information set by a setter.

A phase different from a phase corresponding to a sound to be output when a rotary speaker is oriented forwardly may be set as the reset phase information in a case where the periodic change of the sound signal corresponds to a sound to be output from the rotary speaker.

The determining may include determining a plurality of phases at which the periodic change supplied to the sound signal starts based on a plurality of initial phase information pieces, and the supplying may include supplying a periodic change to the sound signal based on the plurality of phases.

A sound signal conversion program according to yet another aspect of the present disclosure causes a computer to execute a process of receiving a sound signal, accepting a start instruction for starting supply of a periodic change to the sound signal, determining a phase at which the periodic change supplied to the sound signal starts based on initial phase information when the start instruction is accepted, and supplying the periodic change to the sound signal, and outputting the sound signal to which the periodic change is supplied.

While preferred embodiments of the present disclosure have been described above, it is to be understood that variations and modifications will be apparent to those skilled in the art without departing the scope and spirit of the present disclosure. The scope of the present disclosure, therefore, is to be determined solely by the following claims.

We claim:

1. A sound signal conversion device comprising:

a supplier that supplies a periodic change to an input sound signal and outputs the sound signal to a speaker to which the periodic change is supplied, wherein the supplier includes a phase determiner that determines a phase at which the periodic change supplied to the sound signal starts based on initial phase information when receiving a start instruction from a button for starting supply of the periodic change to the sound signal, and stops supplying the periodic change to the sound signal and updates the initial phase information based on a current phase of the periodic change with respect to the sound signal, when accepting the stop instruction, in a case where reset phase information is not provided.

2. The sound signal conversion device according to claim 1, wherein the supplier stops supplying the periodic change to the sound signal and updates the initial phase information based on the reset phase information, when accepting a stop instruction for stopping the supply of the periodic change to the sound signal, and when the supplier is provided with the reset phase information, wherein the reset phase information is a phase at which an operator desires a periodic change to start.

3. The sound signal conversion device according to claim 2, wherein the supplier stops supplying the periodic change to the sound signal and updates the initial phase information based on the reset phase information, when accepting a first stop instruction, and stops supplying the periodic change to the sound signal and updates the initial phase information based on a current phase of the periodic change with respect to a sound signal, when accepting a second stop instruction.

4. The sound signal conversion device according to claim 2, wherein the supplier updates the initial phase information based on the reset phase information that is set by the operator.

5. The sound signal conversion device according to claim 4, wherein a phase different from a phase corresponding to a sound to be output when the speaker is oriented forwardly is set as the reset phase information by the operator in a case where the periodic change of the sound signal corresponds to the sound to be output from the speaker.

6. The sound signal conversion device according to claim 1, wherein the phase determiner determines a plurality of phases at which the periodic change supplied to the sound signal starts based on a plurality of initial phase information pieces, and the supplier supplies the periodic change to the sound signal based on the plurality of phases, wherein the plurality of initial phase information pieces is determined when a start instruction for starting supply of the periodic change to the sound signal is received.

7. A musical instrument including the sound signal conversion device according to claim 1.

8. A sound signal conversion method of:

receiving a sound signal;

accepting a start instruction for starting supply of a periodic change to the sound signal;

determining a phase at which the periodic change supplied to the sound signal starts based on initial phase information when the start instruction is accepted, and supplying the periodic change to the sound signal;

stopping supplying the periodic change to the sound signal and updating the initial phase information based on a current phase of the periodic change with respect to the sound signal, when accepting the stop instruction, in a case where reset phase information is not provided; and outputting the sound signal to which the periodic change is supplied.

9. The sound signal conversion method according to claim 8, wherein the supplying includes stopping supplying the periodic change to the sound signal and updating the initial phase information based on reset phase information, when a stop instruction for stopping the supply of the periodic change to the sound signal is accepted, in a case where the reset phase information is provided.

10. The sound signal conversion method according to claim 9, wherein the supplying includes stopping supplying the periodic change to the sound signal and updating the initial phase information based the reset phase information, when accepting a first stop instruction, and stops supplying the periodic change to the sound signal and updates the initial phase information based on a current phase of the periodic change with respect to a sound signal, when accepting a second stop instruction.

11. The sound signal conversion method according to claim 9, wherein the supplying includes updating the initial phase information based on the reset phase information set by a setter.

12. The sound signal conversion method according to claim 11, wherein a phase different from a phase corresponding to a sound to be output when the speaker is oriented forwardly is set as the reset phase information in a case where the periodic change of the sound signal corresponds to the sound to be output from the rotary speaker.

13. The sound signal conversion method according to claim 8, wherein the determining includes determining a plurality of phases at which the periodic change supplied to the sound signal starts based on a plurality of initial phase information pieces, and the supplying includes supplying the periodic change to the sound signal based on the plurality of phases.

14. A non-transitory computer readable medium storing a sound signal conversion program, which when executed by a computer, causes a computer to:

receive a sound signal;

accept a start instruction for starting supply of a periodic change to the sound signal;

determine a phase at which the periodic change supplied to the sound signal starts based on initial phase information when the start instruction is accepted, and supplying the periodic change to the sound signal;

stop supplying the periodic change to the sound signal and update the initial phase information based on a current phase of the periodic change with respect to the sound signal, when accepting the stop instruction, in a case where reset phase information is not provided; and output the sound signal to which the periodic change is supplied.

15. The non-transitory computer readable medium storing a sound signal conversion program according to claim 14, wherein the supplying includes stopping supplying the periodic change to the sound signal and updating the initial phase information based on reset phase information, when a stop instruction for stopping the supply of the periodic change to the sound signal is accepted, in a case where the reset phase information is provided.

16. The non-transitory computer readable medium storing a sound signal conversion program according to claim 14, wherein the supplying includes stopping supplying the periodic change to the sound signal and updating the initial phase information based the reset phase information, when accepting a first stop instruction, and stops supplying the periodic change to the sound signal and updates the initial phase information based on a current phase of the periodic change with respect to a sound signal, when accepting a second stop instruction.

* * * * *